US006868794B2

(12) United States Patent
Bullock et al.

(10) Patent No.: US 6,868,794 B2
(45) Date of Patent: Mar. 22, 2005

(54) MATERIAL TURN TABLE

(75) Inventors: William C. Bullock, Smithfield, VA (US); Yves Triolet, Hayes, VA (US)

(73) Assignee: Newport News Shipbuilding and Dry Dock Company, Newport News, VA (US)

( * ) Notice: Subject to any disclaimer, the term of this patent is extended or adjusted under 35 U.S.C. 154(b) by 185 days.

(21) Appl. No.: 10/265,739

(22) Filed: Oct. 8, 2002

(65) Prior Publication Data

US 2004/0065234 A1 Apr. 8, 2004

(51) Int. Cl.[7] ..... A47B 57/00
(52) U.S. Cl. ..... 108/94; 108/139
(58) Field of Search ..... 108/94, 142, 20, 108/21, 22, 106, 107, 95, 139; 74/16; 248/349.1, 425

(56) References Cited

U.S. PATENT DOCUMENTS 2,600,922 A * 6/1952 Rodolfa ..... 108/139
3,004,571 A * 10/1961 Gerbrandt ..... 108/139
3,653,340 A * 4/1972 Bugg ..... 108/139
4,625,087 A * 11/1986 Jorgensen et al. ..... 108/20
4,647,745 A * 3/1987 Danley ..... 108/20
4,690,362 A * 9/1987 Helgeland ..... 248/349.1
4,793,266 A * 12/1988 Napolitano et al. ..... 108/139
4,831,234 A 5/1989 Myers
4,924,781 A * 5/1990 Span ..... 108/22
5,479,867 A * 1/1996 Blevins et al. ..... 108/94
5,499,524 A 3/1996 Len
5,524,502 A * 6/1996 Osanai ..... 108/20

FOREIGN PATENT DOCUMENTS

GB 2235426 A * 3/1991 ..... B60S/13/02

OTHER PUBLICATIONS

McMaster–Carr Supply Company, Catalog 108, New Brunswick, New Jersey, Turntables, p. 969.

* cited by examiner

*Primary Examiner*—Jose V. Chen
(74) *Attorney, Agent, or Firm*—Hunton & Williams LLP

(57) ABSTRACT

The disclosure provides a material turn table for supporting objects to be worked on. The material turn table includes a placement plate upon which objects are placeable; a supporting plate; and a support assembly that connects the placement plate to the supporting plate in such a manner that the placement plate is rotateably supported above the supporting plate. The support assembly includes an annular first pipe connected to the placement plate and an annular second pipe connected to the supporting plate. A portion of a length of the first pipe is disposed telescopically relative to the second pipe. An annular bearing assembly connects the small pipe to the large pipe.

13 Claims, 3 Drawing Sheets

MATERIAL TURN TABLE

BACKGROUND OF THE INVENTION

The welding of large objects, such as ballistic hatch covers, presents special challenges. In the welding of objects, it is desirable to position the object so that a welder, i.e., the person performing the welding, is provided easy access to the portions of the object or objects to be welded. However, using known techniques, this positioning of the object is often hard to attain.

For example, a crane may be used to initially position a large, heavy object in a position for welding. However, it is often desirable that the object be moved during the welding process. This presents the need to again use the crane, for example, to reposition the object and/or use a number or workers to reposition the object. Such crane repositioning and/or labor can be highly time consuming and can adversely impact the continuity of the overall welding process of the object. This can effect the quality of the weld.

Further, the inability of a welder to reposition an object being welded, on an on-going basis during the welding, results in a substantial inconvenience. In particular, the constant movement required by the welder around an object and the potentially awkward positions required of the welder may often result in unnecessary overall fatigue, as well as muscular fatigue in particular.

The device provided by the invention addresses the above problems as well as others.

BRIEF SUMMARY OF THE INVENTION

In accordance with one embodiment, the invention provides a material turn table for supporting objects to be worked on. The material turn table includes a placement plate upon which objects are placeable; a supporting plate; and a support assembly that connects the placement plate to the supporting plate in such a manner that the placement plate is rotateably supported above the supporting plate. The support assembly includes an annular first pipe connected to the placement plate and an annular second pipe connected to the supporting plate. A portion of a length of the first pipe is disposed telescopically relative to the second pipe. An annular bearing assembly connects the small pipe to the large pipe.

BRIEF DESCRIPTION OF THE DRAWINGS

The present invention can be more fully understood by reading the following detailed description together with the accompanying drawing, in which like reference indicators are used to designate like elements, and in which.

DETAILED DESCRIPTION OF THE INVENTION

Hereinafter, aspects of the material turn table in accordance with various embodiments of the invention will be described. The material turn table of the invention is directed to the above stated problems, as well as other problems, that are present in conventional techniques and devices. As used herein, any term in the singular may be interpreted to be in the plural, and alternatively, any term in the plural may be interpreted to be in the singular.

The invention provides a material turn table that allows a welder to easily move a piece being welded. In accordance with one embodiment of the invention, the material turn table may typically be constructed of metal and include three main parts. The three main parts include a top plate, a bottom plate, and a bearing or support assembly attaching the top plate to the bottom plate. The tool allows the welder to rotate/move the material or work, by hand, with little effort. The top plate sits on the bearing assembly located on the bottom plate in such a manner to allow level and almost effortless movement.

The arrangement eliminates much material handling by a crane, for example. The arrangement further allows the welder easier and quicker access for actual welding. Also, the welder can position himself with less effort. This alone reduces fatigue. The quality of the weld is increased also. Substantial amounts of time can be saved including both crane time as well as manual labor otherwise needed to move heavy objects.

Figure 1:
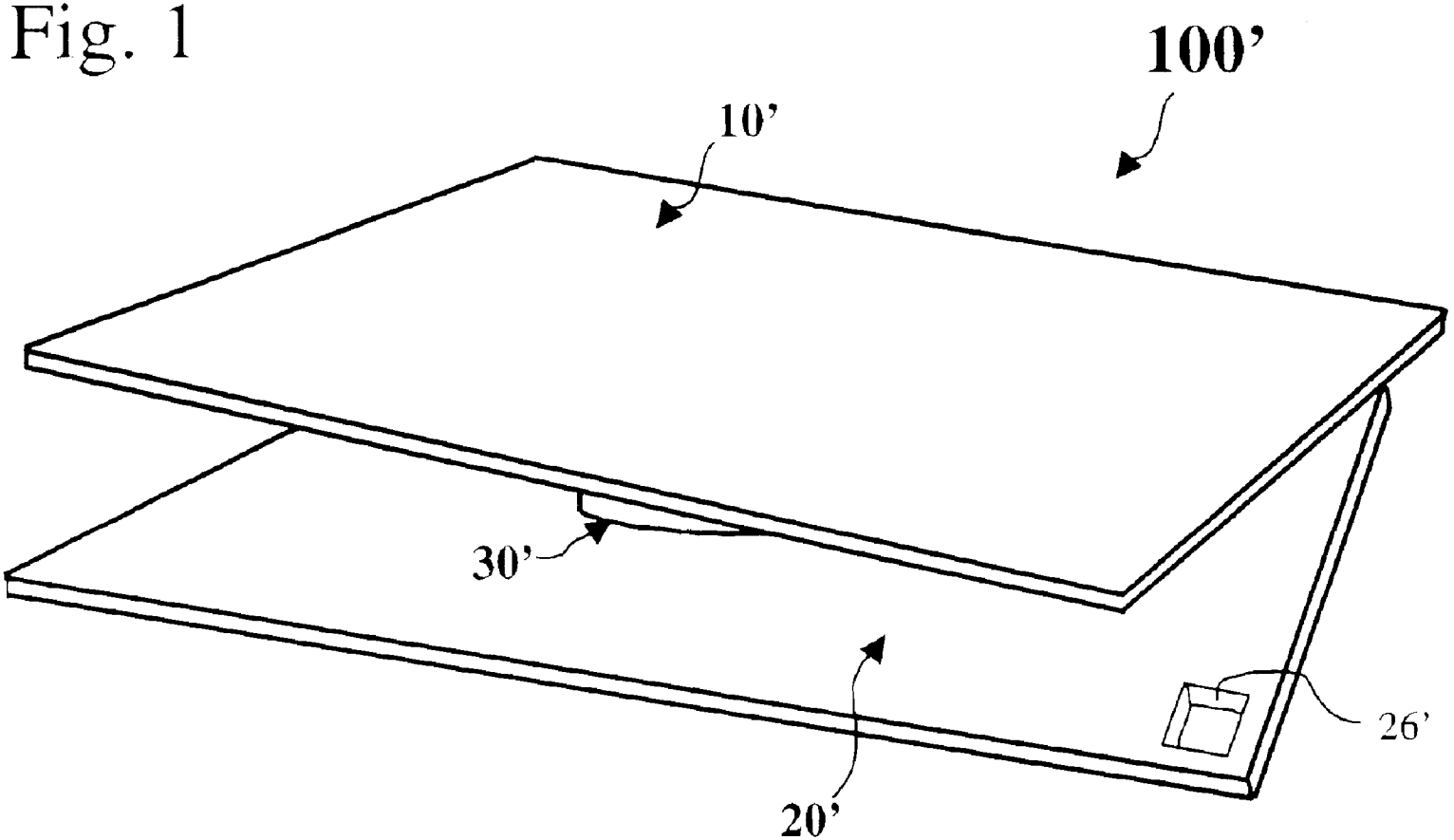
FIG. 1 is a perspective view of a material turn table in accordance with one embodiment of the invention.

Hereinafter, further aspects of the invention will be described with reference to FIG. 1. FIG. 1 is a perspective diagram showing a material turn table 100' in accordance with one embodiment of the invention. As shown in FIG. 1, the material turn table 100' includes a placement plate 10' and a supporting plate 20'. Work may be placed on the placement plate 10' for welding, for example. The supporting plate 20' may be placed on a surface so as to support the material turn table 100'. The placement plate 10' and the supporting plate 20' are connected, i.e., the placement plate 10' is supported on the supporting plate 20' by a support assembly 30'.

The support assembly 30' allows the placement plate 10' to be easily rotated and supported upon the supporting plate 20'. In particular, the support assembly 30' allows the placement of heavy objects, such as ballistic hatch covers, upon the placement plate 10' so as to be easily moved by a welder. The placement plate 10' and/or the supporting plate 20' may be provided with an aperture 26' through which a dog extends. This arrangement is used to prevent the supporting plate 20' from rotating on a supporting surface. However, other arrangements may be used, to preclude rotation of the supporting plate 20' as desired. The placement plate 10' and the supporting plate 20' may be rectangular, as shown in FIG. 1, or any other shape as desired.

Figure 2:
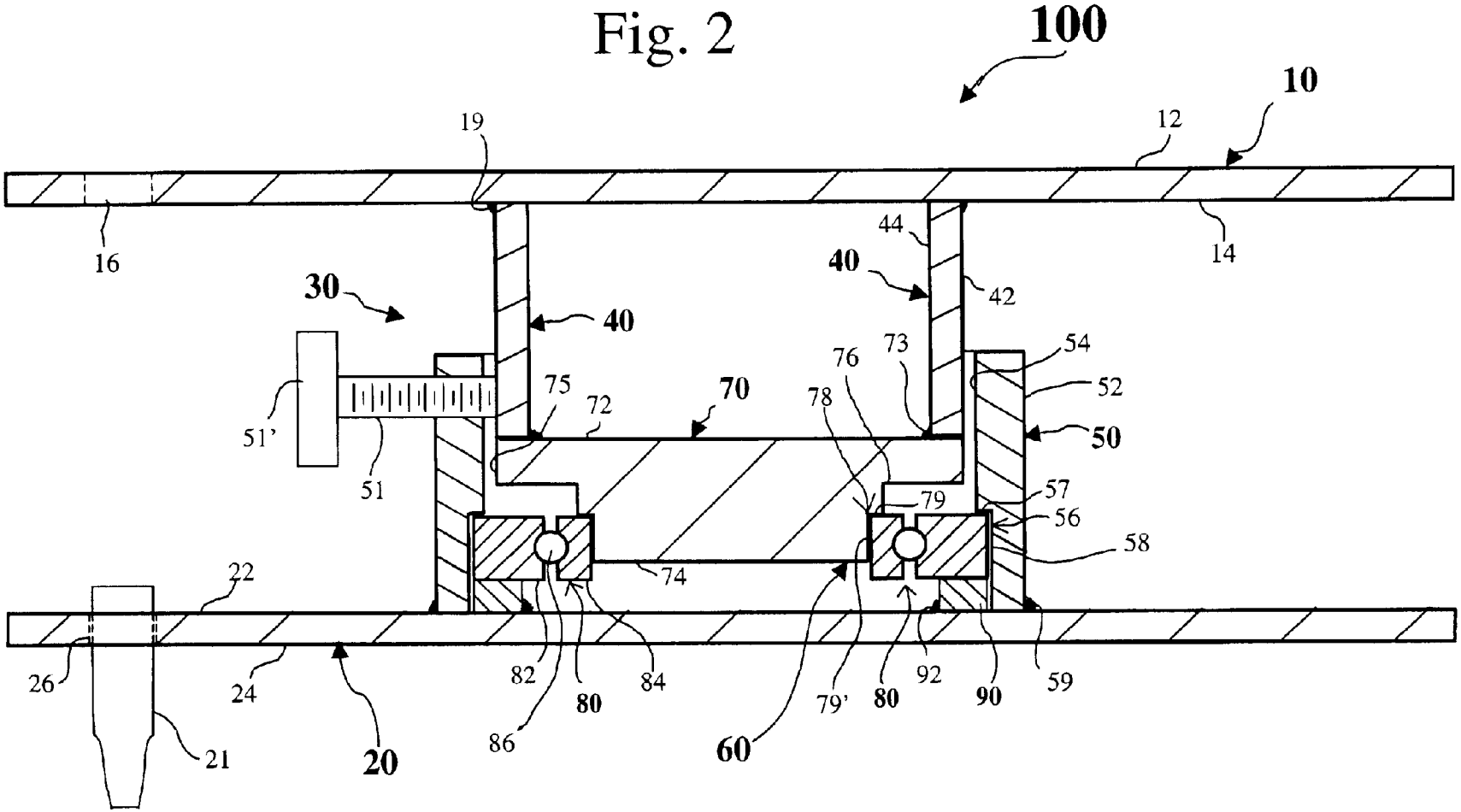
FIG. 2 is a cross-sectional side view of a material turn table in accordance with a further embodiment of the invention.

Hereinafter, further details of a material turn table will be described with reference to FIG. 2, in accordance with one embodiment of the invention. FIG. 2 is a cross sectional diagram of a material turn table 100. As shown in FIG. 2, a material turn table 100 includes a placement plate 10 and a supporting plate 20. The placement plate 10 is supported upon the supporting plate 20 by a support assembly 30. In turn, it should of course be appreciated that the supporting plate 20 is supported upon a further suitable surface, such as a concrete or steel floor, for example.

The support assembly 30 is constructed with components so as to support heavy loads that are placed on the placement plate 10. The support assembly 30, in accordance with one embodiment of the invention, includes a small pipe 40, a large pipe 50 and a bearing assembly 60.

As shown in cross-section in FIG. 2, the small pipe 40, i.e., a first pipe, may be annular or circular in shape. The small pipe 40 includes a small pipe outer surface 42 and a small pipe inner surface 44. The top of the small pipe 40 as shown in FIG. 2 is be connected to the placement plate 10 in any suitable manner. For example, the small pipe 40 may be attached to the placement plate 10 using a circular weld 19. A portion of the length of the small pipe 40 is disposed within the large pipe 50, i.e., a second pipe. That is, as shown in FIG. 2, a lower portion of the small pipe 40 is disposed in the upper portion on the large pipe 50. In other words, a portion of a length of the small pipe is disposed telescopically relative to the large pipe, i.e., in a concentric relationship.

The large pipe 50, i.e., a second pipe, is annular or circular in shape and includes a large pipe outer surface 52 and a large pipe inner surface 54. The diameter of the large pipe inner surface 54 is slightly largely than the small pipe outer surface 42. As should be appreciated, this allows the small pipe 40 to be positioned within the large pipe 50. The large pipe 50 is attached to the supporting plate 20 in some suitable manner. For example, the large pipe 50 may be attached to the supporting plate 20 using a circular weld 59, as shown in FIG. 2.

Figure 3:
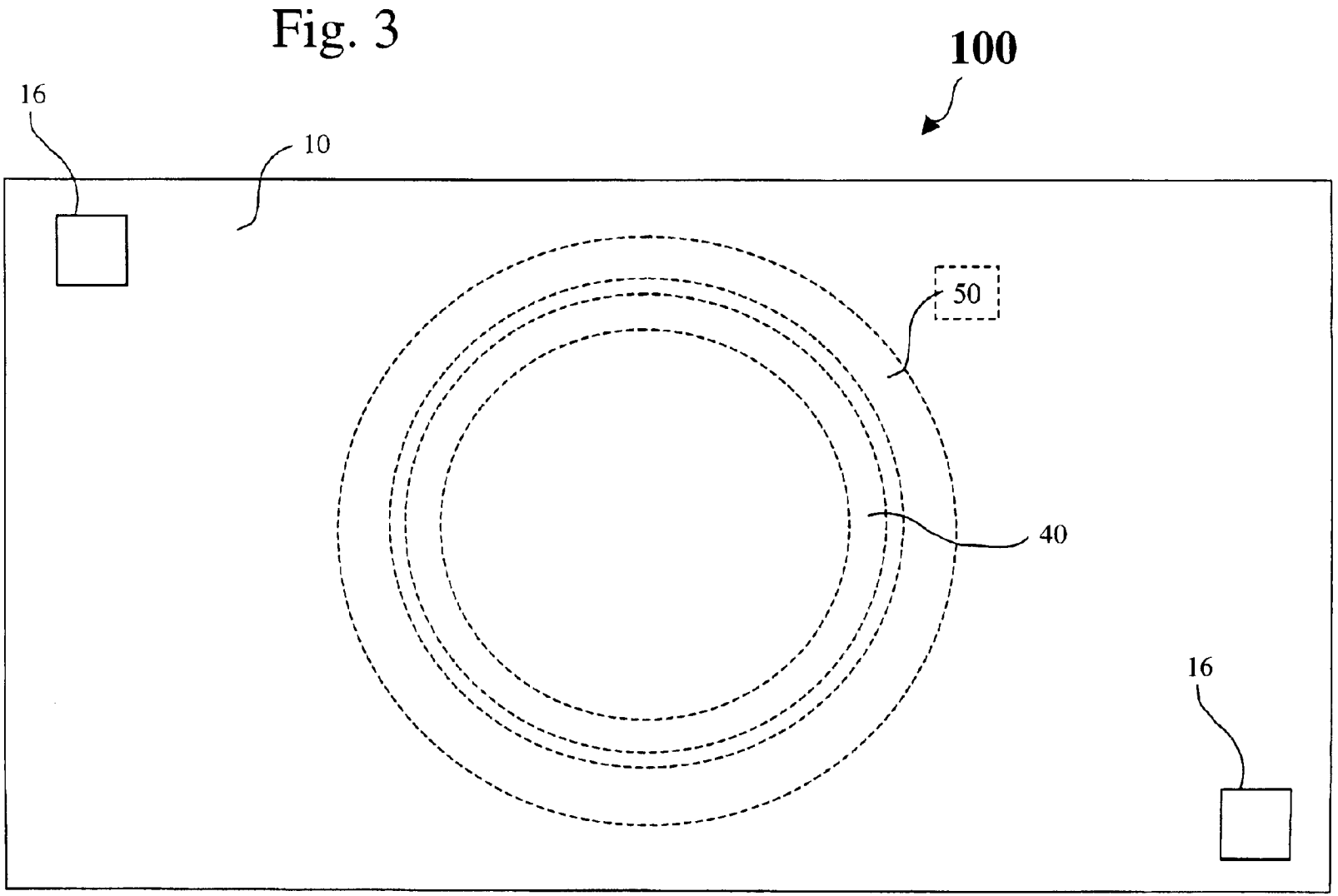
FIG. 3 is a top view of the material turn table of FIG. 2 in accordance with an embodiment of the invention

FIG. 3 is a top view of the material turn table 100 of FIG. 2. As shown, the material turn table 100 includes the placement plate 10. Also, FIG. 3 shows the small pipe 40 and the large pipe 50 in phantom. That is, the small pipe 40 and the large pipe 50 are shown disposed below the placement plate 10. As shown in FIG. 2, the small pipe 40 is attached to the placement plate 10.

With further reference to FIG. 2, the bearing assembly 60 includes a bearing holder 70, a bearing 80 and a spacer 90, each of which may be annular or circular in shape. These components serve to rotateably support the small pipe 40 within the large pipe 50, and in turn support the placement plate 10 upon the supporting plate 20.

The bearing 80 includes an annular outer bearing portion 82 and an annular inner bearing portion 84. The outer bearing portion 82 is rotateably connected to the inner bearing portion 84 by a plurality of ball bearings 86, which run in respective tracks in the outer bearing portion 82 and the inner bearing portion 84 in a known manner. Accordingly, specifics of the bearing 80, including the interconnection of the outer bearing portion 82 to the inner bearing portion 84, will not hereinafter be described in further detail.

In accordance with one embodiment of the invention, the bearing holder 70 includes a bearing holder top surface 72 and a bearing holder bottom surface 74. The small pipe 40 is disposed upon the bearing holder top surface 72. For example, the small pipe 40 may be connected to the bearing holder 70 using a tack weld 73, as shown in FIG. 2. As shown in FIG. 2, the bearing holder 70 also includes a bearing holder step 76 and a bearing holder shoulder 78. The bearing holder 70 including the bearing holder top surface 72, the bearing holder bottom surface 74, the bearing holder step 76 and a bearing holder shoulder 78 may all be constructed of one integral piece of material, i.e., one casting, for example. Further, the inner pipe 40 and the bearing holder 70 might all be constructed of one integral piece also.

The bearing holder shoulder 78 includes an annular flange 79 and an annular shoulder side 79'. The flange 79 and the shoulder side 79' are disposed at right angles thus forming a groove into which the inner bearing portion 84 is received, as shown in FIG. 2.

Specifically, the bearing holder shoulder 78 is supported by the bearing 80, and more specifically is supported by the inner bearing portion 84. The bearing holder shoulder 78 of the bearing holder 70 mates with the inner bearing portion 84. That is, the shoulder side 79' of the bearing holder shoulder 78 is disposed and connected to an inner surface of the inner bearing portion 84. Further, the flange 79 rests upon an upper surface of the inner bearing portion 84. The bearing holder shoulder 78 may be fastened to the inner bearing portion 84 in any suitable manner, such as a friction fit or welding, for example.

The bearing holder 70 is also provided with the bearing holder step 76, as shown in FIG. 2. The bearing holder step 76 provides a step so that the bearing holder 70 is spaced from the outer bearing portion 82. Accordingly, the bearing holder 70 is spaced from the outer bearing portion 82 so as to allow the bearing holder 70 to freely rotate relative to the outer bearing portion 82.

Further, the outer bearing portion 82 of the bearing 80 is connected to the large pipe 50. That is, the large pipe 50 includes a shoulder arrangement 56, which is disposed along a portion of the large pipe inner surface 54. The shoulder arrangement 56 includes a shoulder top 57 and a shoulder side 58. The shoulder top 57 and the shoulder side 58 of the large pipe inner surface 54 collectively form a groove or recess into which the outer bearing portion 82 is received. The outer bearing portion 82 may be secured within the shoulder arrangement 56 using any suitable technique such as a friction fit or a weld, for example.

Further, the bearing 80 is supported in a spaced relationship from the supporting plate 20 using a spacer 90. That is, the spacer 90 is disposed between the outer bearing portion 82 and the supporting plate 20. The spacer 90 may be secured to the outer bearing portion 82 and/or the supporting plate 20 in any suitable manner. For example, a tack weld 92 may be used to secure the spacer 90 to the supporting plate 20, as shown in FIG. 2. Accordingly, the spacer 90 supports the bearing 80 above the supporting plate 20 in such a manner that the inner bearing portion 84 can freely rotate relative to the supporting plate 20.

As noted above, the supporting plate 20 may be supported on a suitable surface, such as the floor of a machine shop, for example. It should be appreciated that suitable devices may be used to secure the supporting plate 20 to such a supporting surface, or another supporting structure, i.e., so as to prevent rotation. For example, the supporting plate 20 may be provided with an aperture 26. A dog 21, as shown in FIG. 2, may be passed through each aperture 26 and into a supporting structure, such as a steel floor, so as to secure the supporting plate 20. However, other devices may also be used to secure the supporting plate 20. Further, the placement plate 10 may be provided with apertures 16, which are similar to the apertures 26. The apertures in the placement plate 10 allow the material turntable to be turned over and used, i.e., so that the placement plate 10 is on the supporting surface.

In accordance with one embodiment of the invention, the large pipe 50 may be provided with a lock down device, so as to secure the large pipe 50 to the small pipe 40, i.e., so as to prevent relative rotation between the large pipe 50 and the small pipe 40. For example, the lock down device might take the form of a set screw or bolt 51 extending through the large pipe 50, as shown in FIG. 2. The set bolt 51 is threadably disposed in the large pipe 50, so as to tighten down on the small pipe 40. For example, the set bolt 51 may include a winged arrangement 51' so as to assist an operator in tightening the set bolt 51 against the small pipe 40.

In the exemplary embodiment described above, the small pipe 40 is attached to the placement plate 10 and the large pipe 50 is attached to the supporting plate 20. However, it should be appreciated that these elements, as well as other elements, of the material turn table 100 may be reversed in one manner or another. That is, for example, small pipe 40 may be attached to the supporting plate 20 and the large pipe 50 might be attached to the placement plate 10.

The material turn table as described above may be assembled in any suitable manner and in any order as should be appreciated by one or ordinary skill in the art. Further, any of a variety of techniques may be used to connect the various elements including welding or friction fit, as described above. Other techniques to connect the various components may also be used including mechanical fasteners, for example. For example, a tack weld might be used on the inside of the small pipe 40 and a solid weld on the outside of the small pipe to attach the small pipe to the placement plate 10. Further, a solid weld might be used around the outside of the large pipe 50 so as to attach the large pipe 50 to the supporting plate 20. As the large pipe 50 is welded to the supporting plate 20, the components might be cooled on an ongoing basis, for example.

Further, it should be appreciated that a single component as described above may instead be multiple components connected together, i.e., the placement plate 10 might be constructed of multiple plates fastened together to provide the placement plate 10. Alternatively, what is described above as two components might instead be one component. For example, the placement plate 10 and the small pipe 40 might be constructed of one steel molding.

The various elements of the material turn table as described above may be constructed of a wide variety of materials. For example, metal or plastic might be used in the material turntable. In particular, carbon steel might be used in the construction.

Further, the dimensions used in construction if the material turntable may vary. For example, each of the placement plate 10 and the supporting plate 20 might be 5/16 inch thick. The large pipe 50 might have an outer diameter of 4.5 inches, a thickness of 0.3 inches, a length of 2.7 inches, and be constructed of steel. The small pipe 40 might have an outer diameter of 3.8 inches, a thickness of 0.3 inches, a length of 1.9 inches, and be constructed of steel. Instead, the inner dimension of the large pipe 50 might be 3.9 inches, but have an inner dimension of 3.94 along the length of the shoulder arrangement 56.

It should be appreciated that various machining may be performed on the components of the material turntable in construction of the material turntable. For example, the large pipe 50 and the small pipe 40 may be not in-round when initially cast. As a result, in construction of the material turntable, a lathe may be used to place the large pipe 50 and the small pipe 40 sufficiently in-round so as to clear each other during rotation of the large pipe 50 relative to the small pipe 40. Various other machining may be employed in construction of the material turntable.

It will be readily understood by those persons skilled in the art that the present invention is susceptible to broad utility and application. Many embodiments and adaptations of the present invention other than those herein described, as well as many variations, modifications and equivalent arrangements, will be apparent from or reasonably suggested by the present invention and foregoing description thereof, without departing from the substance or scope of the invention.

Accordingly, while the present invention has been described here in detail in relation to its exemplary embodiments, it is to be understood that this disclosure is only illustrative and exemplary of the present invention and is made to provide an enabling disclosure of the invention. Accordingly, the foregoing disclosure is not intended to be construed or to limit the present invention or otherwise to exclude any other such embodiments, adaptations, variations, modifications and equivalent arrangements.

What is claimed is:

1. A material turn table for supporting objects to be worked on, comprising:

a placement plate upon which objects are placeable;

a supporting plate; and a support assembly that connects the placement plate to the supporting plate in such a manner that the placement plate is rotateably supported above the supporting plate, the support assembly including:

an annular first pipe connected to the placement plate;

an annular second pipe connected to the supporting plate, a portion of a length of the first pipe disposed telescopically relative to the second pipe; and an annular bearing assembly connecting the first pipe to the second pipe; and wherein the first pipe is an annular small pipe connected to the placement plate, and the second pipe is an annular large pipe connected to the supporting plate, a portion of a length of the small pipe being dispose within the large pipe; and wherein the bearing assembly includes;

a bearing holder connected to a lower portion of the small pipe; and a bearing connected to the large pipe and to the bearing holder, the bearing providing relative rotational movement between the bearing holder and the large pipe.

2. The material turn table of claim 1, wherein the bearing includes an inner bearing portion and an outer bearing portion, the inner bearing portion connected to the bearing holder and the outer bearing connected to the large pipe.

3. The material turn table of claim 2, wherein the bearing assembly further includes a spacer, the spacer disposed between the outer bearing portion and the supporting plate.

4. The material turn table of claim 3, wherein the spacer is disposed adjacent to the large pipe.

5. The material turn table of claim 2, wherein the large pipe includes a shoulder arrangement that provides a recess for receipt of outer bearing portion.

6. The material turn table of claim 5, wherein the shoulder arrangement of the large pipe further provides the recess for receipt of a spacer, the spacer disposed between the outer bearing and the supporting plate.

7. The material turn table of claim 2, wherein the bearing holder includes a shoulder, the shoulder of the bearing holder including a shoulder side and a shoulder flange, the shoulder of the bearing holder receiving a portion of the inner bearing portion.

8. The material turn table of claim 7, wherein the bearing holder further includes an annular step, the step of the bearing holder provided to space the bearing holder from the outer bearing portion.

9. The material turn table of claim 1, wherein the placement plate and the supporting plate are constructed of metal.

10. The material turn table of claim 1, further including a set bolt, the set bolt threadably disposed in the large pipe so as to tighten against the small pipe.

11. The material turn table of claim 1, wherein the supporting plate includes at least one aperture for securing the supporting plate upon a supporting surface.

12. The material turn table of claim 1, wherein the placement plate and the supporting plate are rectangular.

13. A material turn table for supporting objects to be worked on, comprising:

a placement plate upon which objects are placeable;

a supporting plate; and a support assembly that connects the placement plate to the supporting plate in such a manner that the placement plate is rotateably supported above the supporting plate, and the support assembly including:

an annular small pipe connected to the placement plate;

an annular large pipe connected to the supporting plate, a portion of a length of the small pipe disposed within the large pipe; and an annular bearing assembly connecting the small pipe to the large pipe; and wherein the bearing assembly includes:

a bearing holder connected to a lower portion of the small pipe; and a bearing connected to the large pipe and to the bearing holder, the bearing providing relative rotational movement between the bearing holder and the large pipe.

* * * * *